US006049944A

United States Patent [19]

Lopez

[11] Patent Number: 6,049,944

[45] Date of Patent: Apr. 18, 2000

[54] WEB VAC

[76] Inventor: Evelyn A. Lopez, 1776 Enterprise Dr., Fairfield, Calif. 94533-5804

[21] Appl. No.: 09/106,065

[22] Filed: Jun. 29, 1998

[51] Int. Cl.[7] ..... A47L 5/24

[52] U.S. Cl. ..... 15/344; 15/350; 15/410; 15/414

[58] Field of Search ..... 15/344, 350, 410, 15/DIG. 1, 414

[56] References Cited

U.S. PATENT DOCUMENTS

| | | | |
|---|---|---|---|
| 1,156,235 | 10/1915 | Kirby | 15/329 R |
| 2,598,499 | 5/1952 | Breuer et al. | 15/344 X |
| 3,267,510 | 8/1966 | Cote | 15/344 |
| 4,541,142 | 9/1985 | Pudwill | 15/344 X |
| 4,748,712 | 6/1988 | DiGiovanni | 15/327.5 |
| 4,799,460 | 1/1989 | Kuhl | 15/344 |
| 4,920,608 | 5/1990 | Jult et al. | 15/344 X |
| 5,638,572 | 6/1997 | Ferrari | 15/344 X |
| 5,722,112 | 3/1998 | Scanni et al. | 15/344 |
| 5,904,160 | 5/1999 | Wright | 15/344 X |
| 5,909,755 | 6/1999 | Leal | 15/344 X |

FOREIGN PATENT DOCUMENTS

| | | | |
|---|---|---|---|
| 717578 | 10/1954 | United Kingdom | 15/344 |

*Primary Examiner*—Chris K. Moore

[57] ABSTRACT

A web vac including a rechargeable support member that has a bottom side with a pair of rectangular female electrical sockets recessed within the body member. The support member has a top side with a first extension wand extending outwardly. The first extension wand has a first wand end with a pair of cylindrical female electrical sockets recessed therein and a pair of projections spaced from the first wand end. Included is a housing member. The housing member has a rotatable separation means having an intake opening for reception of particles. A motor is positioned within the housing member for creating a vacuum to draw air and particles into the intake opening. The housing member has a second wand extension projecting outwardly from the proximal end. The second wand extension has a second wand end with an F-slot for engaging the pair of projections of the support member. The first wand and the second wand, when coupled, provide electrical current to the motor.

10 Claims, 3 Drawing Sheets

WEB VAC

BACKGROUND OF THE INVENTION

1. Field of the Invention

The present invention relates to a web vac and more particularly pertains to providing a portable device to remove ceiling cobwebs and particularly for hard to clean acoustic ceilings.

2. Description of the Prior Art

The use of a ceiling vacuum is known in the prior art. More specifically, ceiling vacuums heretofore devised and utilized for the purpose of cleaning the ceiling are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,389,004 to Gray, Hoekstra, Martin and Moyher disclose a handle and wand system for a vacuum cleaner. U.S. Pat. No. 4,763,379 to Hanna disclose a cleaning device. U.S. Pat. No. 4,748,712 to DiGiovanni discloses a cobweb vacuum cleaner. U.S. Pat. No. 4,723,338 to Otsubo discloses a suction cleaning device. U.S. Pat. No. 3,971,098 to Davis discloses a gutter cleaning nozzle. Lastly, U.S. Pat. Des. 303,026 to Kilakis discloses a vacuum cleaner extension tool.

In this respect, the web vac according to the present invention substantially departs from the conventional concepts and designs of the prior art, and in so doing provides an apparatus primarily developed for the purpose of providing a portable device to remove ceiling cobwebs and further to clean acoustic ceilings.

Therefore, it can be appreciated that there exists a continuing need for a new device which can be used to remove ceiling cobwebs and particularly for the hard to clean acoustic ceilings. In this regard, the present invention substantially fulfills this need.

SUMMARY OF THE INVENTION

In view of the foregoing disadvantages inherent in the known types of ceiling vacuums now present in the prior art, the present invention provides an improved web vac.

To attain this, the present invention essentially comprises a rechargeable support member which has a bottom side, a top side and a body member with a flat base portion. The bottom side has a pair of rectangular female electrical sockets recessed within the body member. A pair of elongated C-shaped wand clips are fixedly attached in symmetrical placement along the body member. Each C-shaped wand clip is formed of a resilient material. The top side has a first extension wand extending outwardly. The first extension wand has a first wand end with a pair of cylindrical female electrical sockets recessed therein and a pair of projections spaced from the first wand end.

Also, a generally rectangular housing member has a proximal end and a distal end with a peripheral end edge. Included is a rotatable separation means that has an intake opening for reception of particles that are rotatably coupled to one edge of the peripheral end edge of the distal end. The rotatable separation means is rotated back and forth to control entry into the housing member. The housing member has a top wall, a bottom wall and a pair of side walls. A motor is positioned within the housing member for creating a vacuum to draw air and particles into the intake opening.

The bottom wall and the pair of side walls have a plurality of exhaust vents for release of outgoing separated air. The housing member has a second wand extension projecting outwardly from the proximal end. The second wand extension has a second wand end with an F-slot for engaging the pair of projections of the support member. The first wand and the second wand, when coupled, provide electrical current to the motor.

Additionally, a generally rectangular filter is provided. The filter is releasably coupled to the distal end of the housing member and juxtapose the rotatable means during operation of the motor within the housing member. A third extension wand is included. The third extension wand will couple with the first wand and the second wand to increase a distance between the housing member and the support member. Lastly, a recharger unit is provided. The recharger unit has an opening that is sized and shaped for receiving the support member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved web vac which has all the advantages of the prior art ceiling vacuums and none of the disadvantages.

It is another object of the present invention to provide a new and improved web vac which may be easily and efficiently manufactured and marketed.

It is a further object of the present invention to provide a new and improved web vac which is of a durable and reliable construction.

An even further object of the present invention is to provide a new and improved web vac which is susceptible of a low cost of manufacture with regard to both materials and labor, and which accordingly is then susceptible of low prices of sale to the consuming public, thereby making such web vac economically available to the buying public.

Still yet another object of the present invention is to provide a new and improved web vac which provides in the apparatuses and methods of the prior art some of the advantages thereof, while simultaneously overcoming some of the disadvantages normally associated therewith.

Still another object of the present invention is to provide a portable device to remove ceiling cobwebs and further to clean acoustic ceilings.

Lastly, it is an object of the present invention to provide a new and improved a rechargeable support member that has a bottom side with a pair of rectangular female electrical sockets recessed within the body member. The support member has a top side with a first extension wand extending outwardly. The first extension wand has a first wand end with a pair of cylindrical female electrical sockets recessed therein and a pair of projections spaced from the first wand end. Included is a housing member. The housing member has a rotatable separation means having an intake opening for reception of particles. A motor is positioned within the housing member for creating a vacuum to draw air and particles into the intake opening. The housing member has a second wand extension projecting outwardly from the proximal end. The second wand extension has a second wand end with an F-slot for engaging the pair of projections of the support member. The first wand and the second wand, when coupled, provide electrical current to the motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
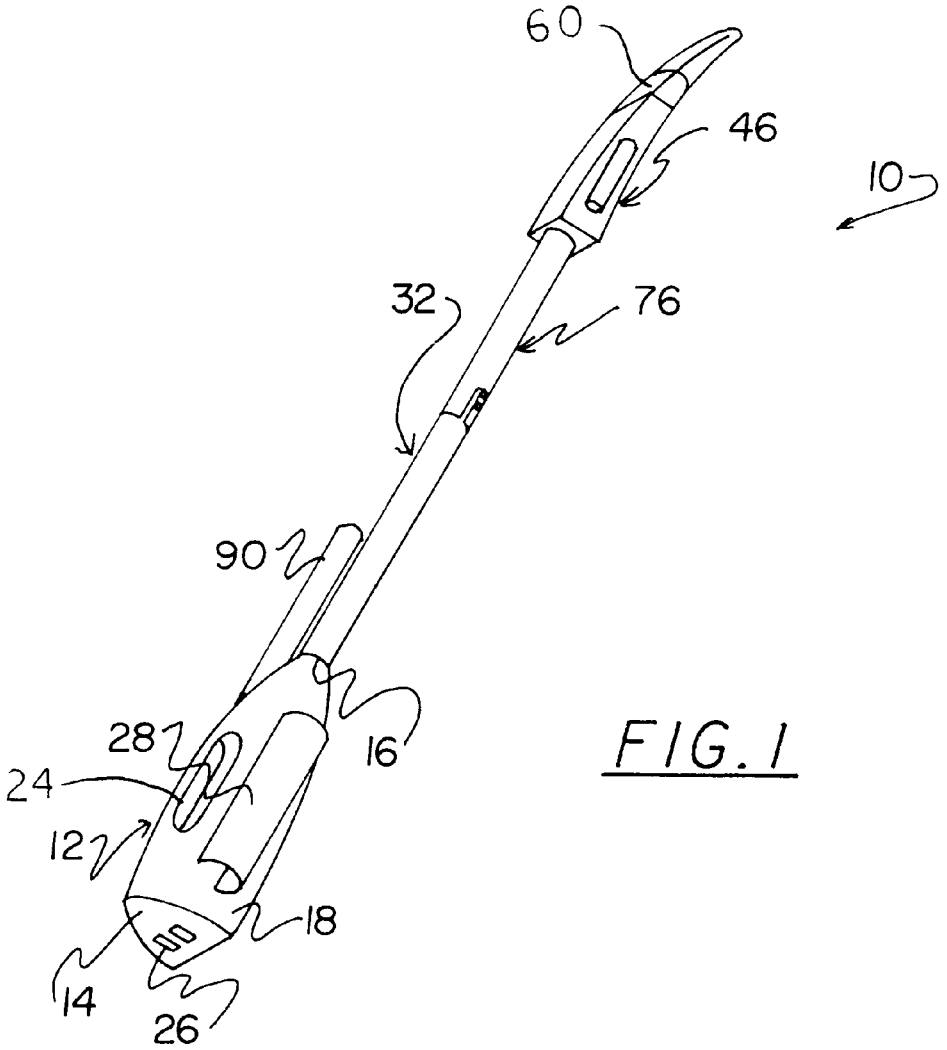
FIG. 1 is a perspective illustration of the preferred embodiment of the web vac constructed in accordance with the principles of the present invention.

With reference now to the drawings, and in particular to FIG. 1 thereof, a web vac embodying the principles and concepts of the present invention and generally designated by the reference numeral 10 will be described.

The present invention, the new and improved Web vac, is comprised of a plurality of components. Such components in their broadest context include support member, housing member and a plurality of extension wands. Such components are individually configured and correlated with respect to each other so as to attain the desired objective.

Figure 5:
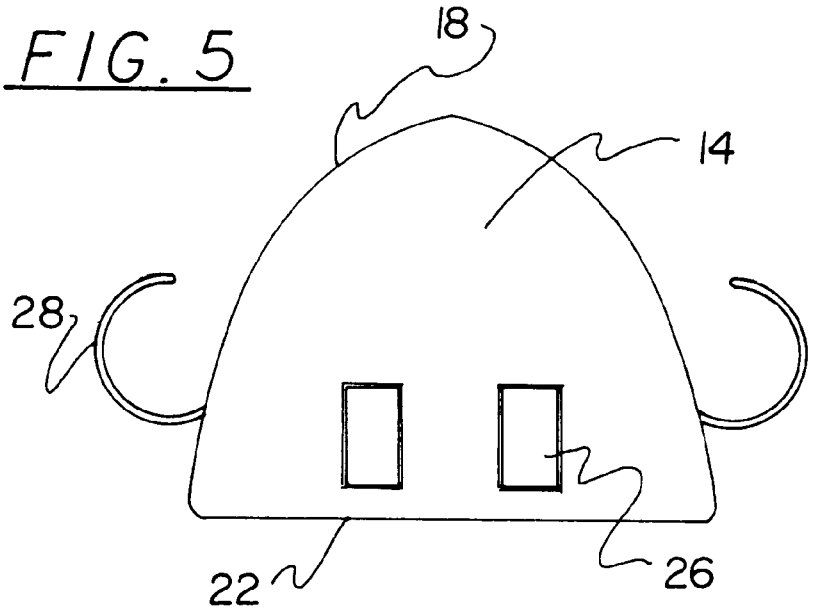
FIG. 5 is bottom view of the support member of the present invention.
Figure 5:
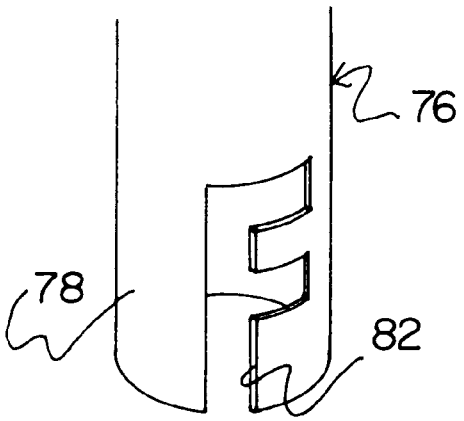

More specifically, the present invention includes a rechargeable support member 12. The support member houses a rechargeable battery that is not shown. The support member is formed of a light weight plastic and has a bottom side 14, a top side 16 and a body member 18. As seen in FIG. 5, the body member has a flat base portion 22. Included along the body member is an opening defining a handle 24.

Figure 6:
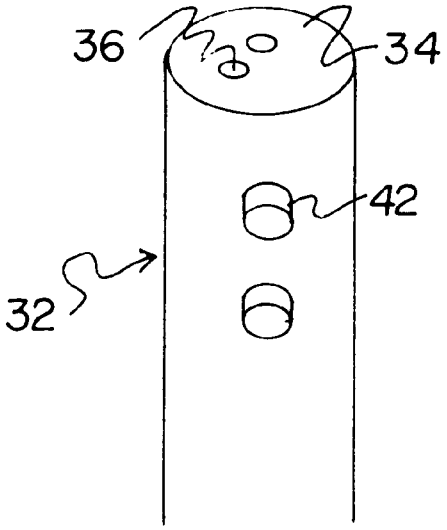
FIG. 6 is an enlarged view of the coupling components of the first extension wand and the second extension wand.

Also, as shown in FIGS. 1 and 5, the bottom side has a pair of rectangular female electrical sockets 26 that are recessed within the body member. A pair of elongated C-shaped wand clips 28 are fixedly attached in symmetrical placement along the body member. Each C-shaped wand clip is formed of a resilient material such as metal or plastic. The top side has a first extension wand 32 extending outwardly. The first extension wand has a first wand end 34, as shown in FIG. 6, with a pair of cylindrical female electrical sockets 36 recessed therein. Extending from the first wand end are a pair of projections 42. The pair of projections are spaced from the first wand end in a linear alignment with respect to each other.

Figure 3:
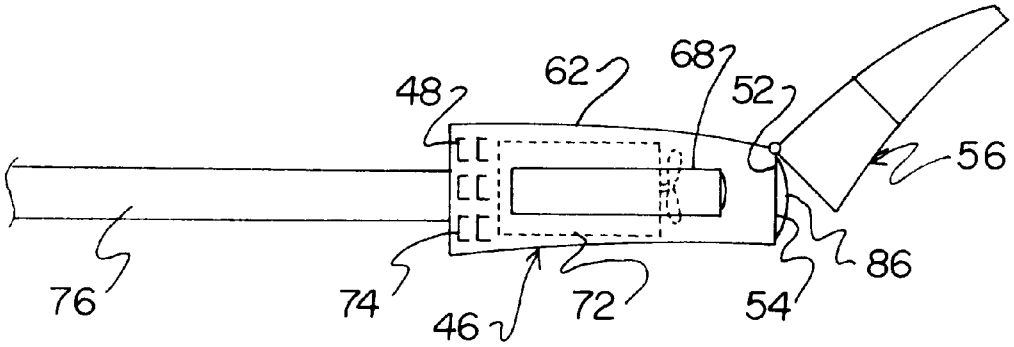
FIG. 3 is side view of the housing member of the present invention with the separation means in an open orientation.
Figure 4:
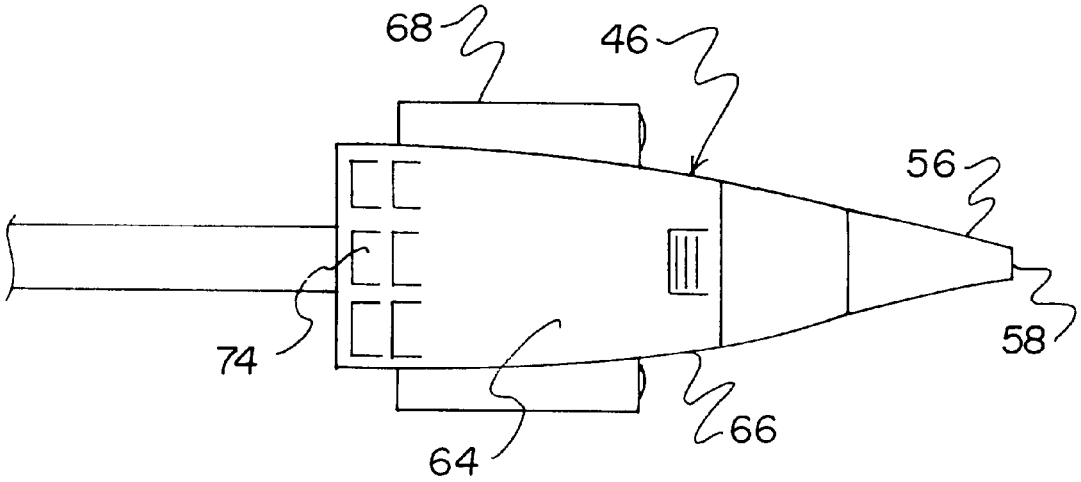
FIG. 4 is a bottom plan view of the housing member of the present invention with the separation means in an operable orientation.

Included is a generally rectangular housing member 46 that has a proximal end 48 and a distal end 52 with a peripheral end edge 54. A rotatable separation means embodied in hollow member 56, with an intake opening 58 for reception of particles, is rotatably coupled to one edge of the peripheral end edge 54 of the distal end. The rotatable separation means is rotated back and forth, as shown in FIGS. 3 and 4, to control entry into the housing member. The rotatable separation means has a resilient member 60. The Resilient member allows the housing member to better conform for accessing the corners of the acoustic ceilings.

The housing member has a top wall 62, a bottom wall 64 and a pair of side walls 66. Each of the side walls has a light 68 mounted thereon. The light illuminates the ceiling corners that are being cleaned by the web vac. A motor 72 is positioned within the housing member for creating a vacuum to draw air and particles into the intake opening 58. The bottom wall and the pair of side walls have a plurality of exhaust vents 74 for release of outgoing separated air.

As illustrated in FIG. 1, the housing member has a second wand extension 76 projecting outwardly from the proximal end 48. The second wand extension has a second wand end 78 with an F-slot 82 for engaging the pair of projections 42 of the support member. The first wand and the second wand, when coupled, provides an electrical current to the motor.

Additionally, a generally rectangular filter 86 is provided. The filter is releasably coupled to the distal end 54 of the housing member and juxtapose the rotatable means during operation of the motor within the housing member.

A third extension wand 90, as seen in FIG. 1, is included. The third extension wand will couple with the first wand and the second wand to increase a distance between the housing member and the support member.

Figure 2:
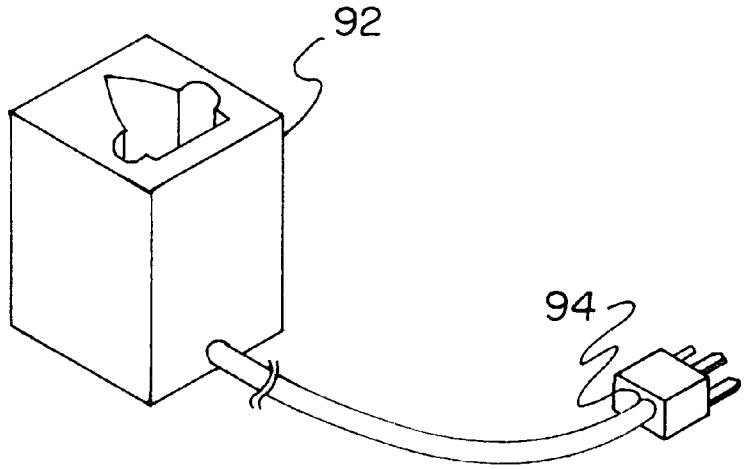
FIG. 2 is an isometric view of the recharging base of the present invention.

Lastly, a recharger unit 92 is provided. The recharger unit has an opening that is sized and shaped for receiving the support member. As seen in FIG. 2, the recharging unit has an electrical plug 94. The support member is placed within the recharger unit when not in use.

The present invention web vac is a portable, easy to carry vacuum cleaner for use with acoustic ceilings. The device is hand-held and powered by a rechargeable battery or batteries. The first extension wand and second extension wand, when coupled, give the device a length of about ten feet. A third extension wand of five feet may be added for higher ceilings. The housing member is the special top cleaning unit. The housing member has a small vacuum motor unit, a filter that collects the cobwebs and other small particles, and side lights. The side lights are halogen lights. The filter may be removed for cleaning.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A new and improved web vac for the removal of cob webs from acoustic ceilings comprising, in combination:

a support member having a bottom side, a top side and a body member with a flat base portion and a conventional rechargeable power supply therebetween, the bottom side having a pair of rectangular female electrical sockets recessed within the body member for the flow of charging current, a pair of elongated C-shaped wand clips being fixedly attached in symmetrical placement along the body member, each C-shaped wand clip being formed of a resilient material, the top side having a first extension wand extending outwardly therefrom, the first extension wand having a first wand end with a pair of cylindrical female electrical sockets recessed therein and a pair of projections spaced from the first wand end;

a generally rectangular housing member having a proximal end and a distal end with a peripheral end edge, a means to effect rotatable separation having an intake opening for reception of particles, means being rotatably coupled to one edge of the peripheral end edge of the distal end, the means to effect rotatable separation being rotated back and forth to control entry into the housing member, the housing member having a top wall, a bottom wall and a pair of side walls, a motor being positioned within the housing member for creating a vacuum to draw air and particles into the intake opening, the bottom wall and the pair of side walls having a plurality of exhaust vents for release of outgoing separated air, the housing member having a second wand extension projecting outwardly from the proximal end thereof, the second wand extension having a second wand end with an F-slot for engaging the pair of projections of the first wand, the first wand and the second wand when coupled adapted to provide electrical current to the motor;

a generally rectangular filter being releasably coupled to the distal end of the housing member in proximity to the rotatable means during operation of the motor within the housing member;

a third extension wand for coupling with the first wand and the second wand for increasing a distance between the housing member and the first extension wand; and a recharger unit having an opening being sized and shaped for receiving the support member therein.

2. A web vac comprising:

a support member having a bottom side and a conventional rechargeable power supply therewithin and with a pair of rectangular female electrical sockets recessed within the body member for the flow of charging current, a pair of elongated C-shaped wand clips being fixedly attached in symmetrical placement along the body member, and a top side with a first extension wand extending outwardly therefrom, the first extension wand having a first wand end with a pair of cylindrical female electrical sockets recessed therein and a pair of projections spaced from the first wand end; and a housing member having a means to effect rotatable separation having an intake opening for reception of particles, said means being rotatably coupled to one end of said housing member to control entry into the housing member, a motor being positioned within the housing member for creating a vacuum to draw air and particles into the intake opening, the housing member having a second wand extension projecting outwardly from the proximal end thereof, the second wand extension having a second wand end with an F-slot for engaging the pair of projections of the first wand, the first wand and the second wand when coupled adapted to provide electrical current to the motor.

3. A web vac as set forth in claim 2, wherein the support member has a top side and a body member with a flat base portion.

4. A web vac as set forth in claim 3, wherein a pair of elongated C-shaped wand clips are fixedly attached in symmetrical placement along the body member, each C-shaped wand clip being formed of a resilient material.

5. A web vac as set forth in claim 2, wherein the housing member has a proximal end and a distal end with a peripheral end edge, and the rotatable separation means being rotatably coupled to one edge of the peripheral end edge of the distal end.

6. A web vac as set forth in claim 5, wherein the rotatable separation means is rotated back and forth to control entry into the housing member.

7. A web vac as set forth in claim 2, wherein, the housing member has a top wall, a bottom wall and a pair of side walls, the bottom wall and the pair of side walls each having a plurality of exhaust vents for release of outgoing separated air created by the motor.

8. A web vac as set forth in claim 2, further including a generally rectangular filter being releasably coupled to the distal end of the housing member in proximity to the rotatable means during operation of the motor within the housing member.

9. A web vac as set forth in claim 2, further including a third extension wand for coupling with the first wand and the second wand for increasing a distance between the housing member and the first extension wand.

10. A web vac as set forth in claim 2, further including a recharger unit having an opening being sized and shaped for receiving the support member therein.

* * * * *